US010407817B2

(12) United States Patent
Valzelli

(10) Patent No.: US 10,407,817 B2
(45) Date of Patent: Sep. 10, 2019

(54) DRYING UNIT

(71) Applicant: Dimore di Lucia Valzelli, Brescia (IT)

(72) Inventor: Lucia Valzelli, Brescia (IT)

(73) Assignee: Dimore di Lucia Valzelli, Brescia (IT)

( * ) Notice: Subject to any disclaimer, the term of this patent is extended or adjusted under 35 U.S.C. 154(b) by 0 days.

(21) Appl. No.: 15/819,565

(22) Filed: Nov. 21, 2017

(65) Prior Publication Data

US 2018/0320303 A1 Nov. 8, 2018

(30) Foreign Application Priority Data

May 4, 2017 (EP) ..... 17425046

(51) Int. Cl.

| | |
|---|---|
| ***D06F 58/10*** | (2006.01) |
| ***D06F 58/20*** | (2006.01) |
| ***A47K 3/28*** | (2006.01) |
| ***D06F 58/28*** | (2006.01) |
| ***D06F 35/00*** | (2006.01) |

(52) U.S. Cl.

CPC ..... *D06F 58/10* (2013.01); *A47K 3/281* (2013.01); *D06F 58/203* (2013.01); *D06F 58/206* (2013.01); *D06F 58/28* (2013.01); *D06F 35/001* (2013.01); *D06F 2058/2803* (2013.01)

(58) Field of Classification Search

CPC ..... D06F 58/10; D06F 58/203; D06F 58/206; D06F 58/28; A47K 3/281

USPC ..... 4/598

See application file for complete search history.

(56) References Cited

U.S. PATENT DOCUMENTS

| | | | | |
|---|---|---|---|---|
| 3,664,159 | A * | 5/1972 | Mazza | D06F 17/04 68/205 R |
| 4,625,432 | A * | 12/1986 | Baltes | A61L 2/06 34/196 |
| 6,570,139 | B1 | 5/2003 | Levy et al. | |
| 6,962,005 | B1 * | 11/2005 | Khosropour | A47K 10/48 34/218 |
| 8,438,753 | B2 * | 5/2013 | Martin | A47K 3/281 236/94 |
| 2005/0016012 | A1 * | 1/2005 | Yang | D06F 58/10 34/486 |
| 2012/0159806 | A1 * | 6/2012 | Dana | D06F 58/203 34/444 |

(Continued)

FOREIGN PATENT DOCUMENTS

| | | | | |
|---|---|---|---|---|
| EP | 0251898 | A1 * | 1/1988 | A47K 3/28 |
| EP | 0 258 762 | A1 | 3/1988 | |
| FR | 2710350 | A1 * | 3/1995 | D06F 58/10 |

(Continued)

OTHER PUBLICATIONS

European Search Report dated Sep. 20, 2017, issued in connection with European Patent Application No. 17 42 5046.

*Primary Examiner* — Tuan N Nguyen

(74) *Attorney, Agent, or Firm* — Akerman LLP

(57) ABSTRACT

A drying unit, which can be easily associated with a domestic and/or hospitality containment cabin, includes a hot air generation structure. Conveniently, the drying unit includes interfacing structure with the containment cabin. The interfacing means is adapted to conduct the hot air generated by the hot air generation means into the containment cabin. The drying unit is adapted to be associated with the containment cabin in order to dry objects contained therein.

15 Claims, 7 Drawing Sheets

(56) References Cited

U.S. PATENT DOCUMENTS

2014/0026313 A1* 1/2014 Zaglio ..... D06F 17/04
4/524

FOREIGN PATENT DOCUMENTS

| | | | |
|---|---|---|---|
| WO | 2007/051456 | A1 | 5/2007 |
| WO | 2010/141747 | A2 | 12/2010 |
| WO | 2014/008874 | A1 | 1/2014 |
| WO | 2015/155643 | A1 | 10/2015 |
| WO | 2016/151392 | A1 | 9/2016 |

* cited by examiner

DRYING UNIT

CROSS-REFERENCE TO RELATED APPLICATIONS

The present application claims priority to European Patent Application No. 17425046.4, filed May 4, 2017, the entirety of which is incorporated herein by reference.

TECHNICAL FIELD

The present disclosure relates to a drying unit and to a relative apparatus for drying objects, for domestic and/or hospitality use, such a drying unit comprising hot air generation means. The following description is made with reference to this application field with the only purpose of simplifying the exposition.

DESCRIPTION OF THE RELATED ART

As it is well known in this technical field, there are apparatuses able to perform a drying and ironing process on garments, fabrics, or in general objects that are to be dried, by supplying hot air in a specific cabin.

For example, there are industrial drying apparatuses wherein garments are disposed along appropriate tunnels, which generally comprise a feeding path of these garments through one or more treatment chambers. Along the sides of the treatment chambers, there are walls equipped for vaporizing and/or ventilating the garments that advance along the path. It is also common to provide vaporization and blowing nozzles acting on the garments.

Such a known solution is used in industrial contexts, but of course it cannot be used in domestic environments, where there is a need for simpler and smaller-sized systems.

For this purpose, there are domestic dryers with spinning drums in which objects to be dried are disposed, those dryers performing the drying process by supplying hot air into the spinning drum, the hot air being produced by means of an electric resistance, for example.

Even if it fulfills the purpose, this known solution is not free of drawbacks, since the spatial obstruction of the dryer is such that it is necessary to find a suitable space for housing it and, due to the reduced spaces of some domestic environments, this is not always possible.

It is also well-known that garments dried in a spinning drum of a dryer are usually hard to iron and display wrinkles which can sometimes endure until further washing.

SUMMARY OF THE DISCLOSURE

An embodiment of the present disclosure is directed to a drying unit having structural and functional features such as to allow overcoming the limitations and drawbacks still affecting the known solutions, in particular a drying unit able to be easily used in domestic and/or hospitality environments, performing the drying process on objects in an efficient, quick manner and requiring only little spatial obstruction.

The drying unit of the present disclosure is structured so as to be easily associated with or integrated into a domestic and/or hospitality containment cabin, such as a shower cabin or any other suitable domestic space, the drying unit generating and conducting hot air into the containment cabin by means of appropriate means interfacing therewith.

In particular, the drying unit is for domestic and/or hospitality use and comprises hot air generation means, wherein the drying unit further comprises interfacing means with a containment cabin, those interfacing means being adapted to conduct the hot air generated by the hot air generation means into the containment cabin, and wherein the drying unit is adapted to be associated with the containment cabin in order to dry objects contained therein.

According to an embodiment, the drying unit can be structurally independent from the containment cabin, or can be integrated into the containment cabin.

According to a preferred embodiment, the containment cabin can be a shower cabin. In this case, the drying unit can comprise connection means adapted to connect the drying unit to a shower head, such a shower head acting as an interface element of that drying unit, which further includes switching means adapted to switch the shower head from a drying configuration, in which it emits hot air, to a washing configuration, in which it emits water, and vice versa. Furthermore, the drying unit can be associated with the top of the shower cabin.

According to an embodiment, the interfacing means with the containment cabin can comprise at least one hot air supply nozzle receiving hot air by means of a hot air delivery fan connected to the hot air generation means.

According to another embodiment, the interfacing means with the containment cabin can comprise at least one canalization, which is arranged alongside at least one wall of the containment cabin and is provided with at least one opening for a further supply of hot air into such a containment cabin, the at least one canalization receiving hot air by means of the hot air delivery fan.

According to another embodiment, the drying unit can further comprise an aspiration duct adapted to retrieve at least part of the hot air from the inside of the containment cabin.

According to yet another embodiment, the drying unit can comprise a central unit adapted to manage and control that drying unit, such a central unit being preferably connected to a user interface through which a user manages the drying process.

According to another embodiment, the hot air generation means can comprise a heat pump connected to air inlet and outlet ducts.

According to another embodiment, the drying unit can comprise an ozone generator adapted to supply ozone in the containment cabin in order to perform a dry sanitization of the objects in the containment cabin.

According to yet another embodiment, the drying unit can further comprise a tank including further volatile substances to be supplied in the containment cabin, those volatile substances being selected from perfumed or anti-wrinkle substances, or from a combination thereof.

According to another embodiment, the drying unit can comprise an illumination system adapted to illuminate the containment cabin.

According to another embodiment, the drying unit of the disclosure can comprise at least one hanger, which is housed in the containment cabin and is adapted to sustain objects to be dried, the at least one hanger being able to let the hot air produced by the hot air generation means circulate therein and comprising a plurality of openings for supplying hot air in the containment cabin.

The present disclosure is also directed to a drying apparatus comprising a containment cabin adapted to house objects to dry therein, as well as a drying unit adapted to conduct hot air into the containment cabin, wherein the drying unit is of the kind described above.

According to an embodiment, the containment cabin can be a shower cabin and the apparatus can comprise means for switching from a configuration in which water is supplied therein to a configuration in which hot air is supplied therein.

According to another embodiment, the containment cabin can house at least one hanger which is adapted to sustain objects to be dried, the at least one hanger being able to let the hot air produced by the hot air generation means circulate therein and comprising a plurality of openings for supplying hot air in the containment cabin.

According to another embodiment, the drying unit can be integrated in the containment cabin.

According to another embodiment, the apparatus can comprise an ozone generator adapted to supply ozone in the containment cabin in order to perform a dry sanitization of the objects in the containment cabin, and/or a tank including further volatile substances to be supplied in the containment cabin, the volatile substances being selected from perfumed or anti-wrinkle substances, or from a combination thereof.

The present disclosure is also directed to a drying unit for domestic and/or hospitality use, comprising hot air generation means and interfacing means with a containment cabin, wherein the interfacing means are adapted to conduct the hot air generated by the hot air generation means into the containment cabin, the drying unit being adapted to be associated with the containment cabin in order to dry objects contained therein, and wherein the containment cabin is a shower cabin, and the drying unit comprises connection means adapted to connect it to a shower head, the shower head acting as an interface element of the drying unit, which further includes switching means adapted to switch the shower head from a drying configuration, in which it emits hot air, to a washing configuration, in which it emits water, and vice versa.

According to an embodiment, the drying unit is structurally independent from the containment cabin, or it is integrated into the containment cabin.

BRIEF DESCRIPTION OF THE DRAWINGS

The characteristics and the advantages of the drying unit and of the apparatus according to the disclosure will become apparent from the following description of an embodiment thereof provided as a non-limiting example with reference to the accompanying drawings.

In the drawings.

DETAILED DESCRIPTION

Figure 1:
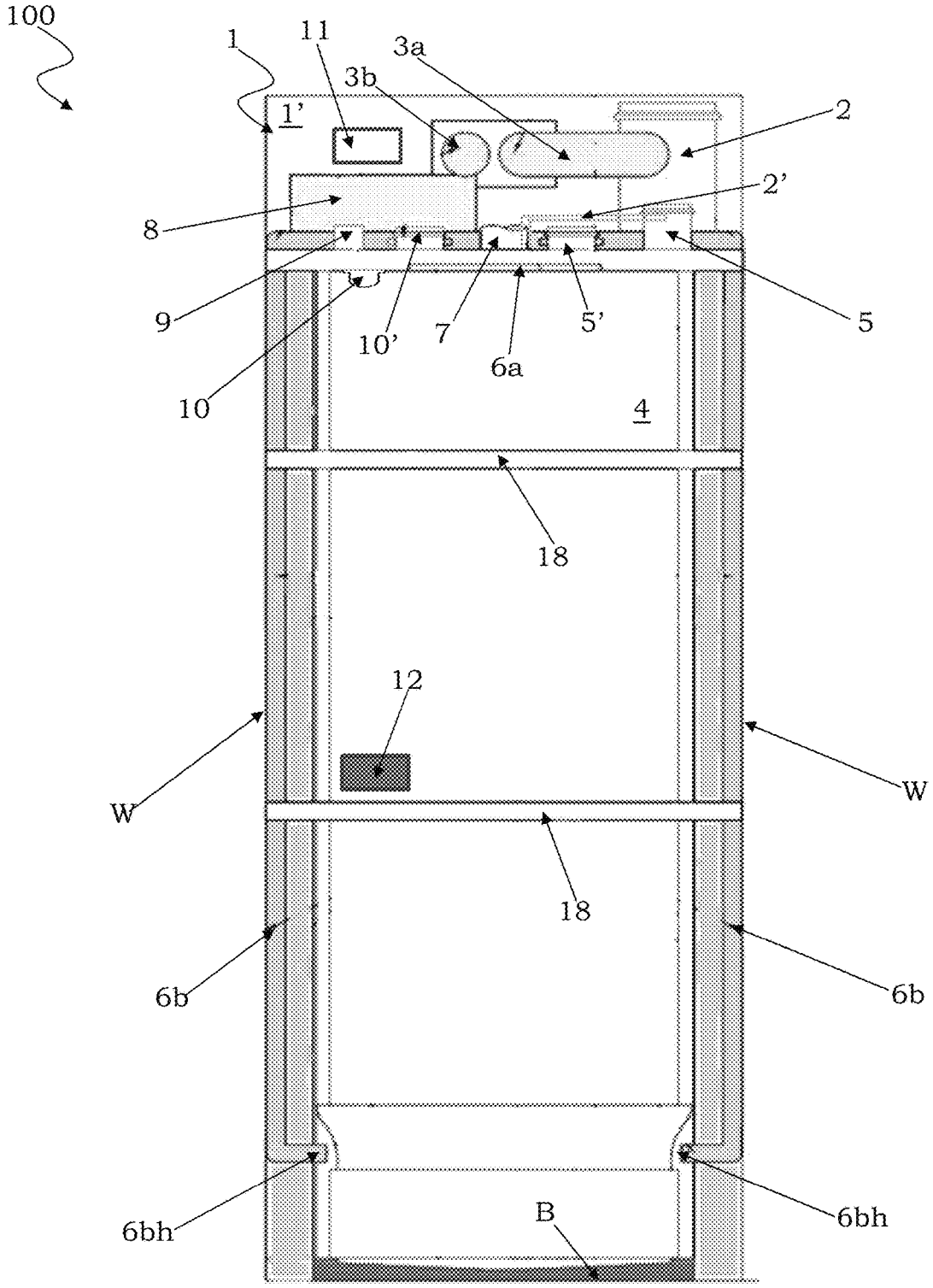
FIG. 1 shows a schematic sectional view of a drying unit according to the present disclosure associated with/integrated into a containment cabin.

With reference to those figures, and in particular to FIG. 1, a drying unit according to the present disclosure is globally and schematically indicated with 1.

It is worth noting that the figures represent schematic views and are not drawn to scale, but instead they are drawn so as to emphasize the important features of the disclosure. Moreover, in the figures, the different elements are depicted in a schematic manner, their shape varying depending on the application desired. It is also noted that in the figures the same reference numbers refer to elements that are identical in shape or function. Finally, particular expedients described in relation to an embodiment illustrated in a figure are also applicable to the other embodiments illustrated in the other figures.

The drying unit 1 is preferably used in a domestic or hospitality environment for drying garments, fabrics, or in general objects that are to be dried and are arranged inside a containment cabin, for example a shower cabin or any other domestic space that is suitable for this purpose.

It is observed that, in the present description, the term "containment cabin" refers to any kind of domestic and/or hospitality space or cabin suitable for containing objects that are to be dried and/or ironed.

In its most general form, the drying unit 1 comprises a main body 1', which includes at least hot air generation means 2 adapted to generate hot air to be conducted into a containment cabin 4.

As is illustrated in FIG. 1, the hot air generation means 2 may include a heat pump, still indicated with the reference number 2, the heat pump being connected to air inlet and outlet ducts 3*a* and 3*b*, respectively, those air inlet and outlet ducts 3*a* and 3*b* being integrated into the drying unit 1.

The heat pump 2 is appropriately sized for the production of hot air to dry objects that are arranged in the containment cabin 4, which is predisposed for this purpose.

Specifically, the heat pump 2 extracts heat from the air of an environment and, by means of a fluid performing a thermodynamic cycle of evaporation/compression/condensation, it produces hot air to be supplied in the containment cabin 4. Accordingly, the heat pump 2 comprises at least one evaporator, one compressor and one condenser, as well as a thermal expansion valve, those components not being illustrated in the figures as they are known in the field.

In a preferred embodiment, the heat pump 2 is a heat pump of the air-air type and, as illustrated above, is connected to the air inlet and outlet ducts 3*a* and 3*b* for introduction/discharge of an air flow in/out of it. Specifically, the heat pump 2 can extract air from the domestic/hospitality environment in which it is disposed, or it can extract air from the outside. In the latter case, the drying unit 1 preferably comprises a filter inside the inlet ducts 3*a* so as to filter the air extracted from the outside.

It is observed that also other types of heat pumps, which operate in ways that are different from the one described above, may be used in the drying unit 1.

Furthermore, it is observed that, even if the adoption of a heat pump is considered a preferred solution, also other hot air generation means can be used and the drying unit 1 is obviously not limited to only one type of hot air generation means.

Advantageously, the drying unit 1 is adapted to be associated in a simple and effective way with the containment cabin 4 containing objects that are to be dried and, to this purpose, the drying unit 1 comprises suitable interfacing means with the containment cabin 4.

The containment cabin 4 is preferably a substantially fluid-tight cabin, so as not to disperse the heat generated by the heat pump 2, and it can be situated in a domestic or hospitality environment (even a preexisting one) and it can be appropriately arranged for drying objects, as will be specified in the following. In particular, the containment cabin 4 is provided with a base portion B, lateral walls W and at least one opening in order to allow the arrangement of objects to be dried therein, that opening being provided with closing means, for example a door.

The containment cabin 4 is preferably a shower cabin, even if the present disclosure is not limited to this and the containment cabin can be any appropriate domestic or hospitality space, as illustrated above. In other words, the drying unit 1 may thus be associated with a shower cabin, as well as it may be associated with any kind of appropriated domestic or hospitality containment space.

The drying unit 1 is therefore suitably structured and sized in order to be associated with the containment cabin 4. In particular, given containment cabin (even a preexisting one), the structure and the sizes of the drying unit 1 are adjusted so that it can be associated with that cabin, allowing the interfacing means to effectively supply the generated hot air.

Conveniently, the drying unit 1 is structurally independent from the containment cabin it interfaces with, the term "structurally independent" indicating that the body 1' (as well as the components included in it) is suitably structured and sized and comprises suitable interconnection means in order to allow the association of such a drying unit to a wide range of containment cabins, in particular, but not limited to, preexisting cabins.

In particular, the drying unit 1 (specifically its body 1') is structured in order to be associated with specific portions of the containment cabin 4, such as, for example, an upper portion, a lower portion, or even a lateral portion, preferably an upper portion but not limited thereto, forming an advantageous drying apparatus, as it will be described in greater detail further on.

Alternatively, the drying unit is integrated into the containment cabin 4, the components thereof (for example the interfacing means, the body, etc.) being structured in such a way that the drying unit 1 is integral with the containment cabin 4, in any case forming an advantageous drying apparatus. Preferably, in this case, the drying unit is already integrated into the containment cabin in the manufacturing step of the containment cabin, realizing a monobloc, single-piece apparatus. In this advantageous embodiment, the drying unit 1 and the containment cabin can be provided together in the form of a prefabricate which is then arranged in a domestic or hospitality environment.

According to a further alternative embodiment, the body 1 may also be external to the containment cabin 4 and suitably connected thereto by means of the interfacing means mentioned above.

In other words, in the context of the present disclosure, the term "associated" indicates both a structurally independent unit, an integrated unit, and an external unit connected to the containment cabin 4.

The drying unit 1 comprises a hot air delivery fan 5, driven by a motor 5', which fan is associated with an output of the heat pump 2 and is adapted to move the hot air generated by the heat pump 2, in particular to conduct it towards the interfacing means with the containment cabin 4 of the drying unit 1.

As a non-restrictive example, the interfacing means comprise a hot air supply nozzle 6*a*, which receives the air from the hot air delivery fan 5. In this way, the air from heat pump 2 is conducted towards the hot air supply nozzle 6 by the hot air delivery fan 5.

Obviously, it is also possible to provide a configuration wherein the hot air delivery fan 5 acts as an interfacing element with the containment cabin 4, even if it is preferable that the air moved by the fan passes through an appropriate supply nozzle 6*a*.

Preferably, the hot air supply nozzle 6*a* is structured in such a way that the hot air that passes through it is finely divided, for example by means of an appropriate diffuser, so as to allow an efficient drying of the objects inside the containment cabin 4. Furthermore, the hot air supply nozzle 6*a* may comprise a filter in order to filter the air supplied inside of the containment cabin 4.

Furthermore, added to or as an alternative to the supply nozzle 6*a* mentioned above, the interfacing means may comprise at least one canalization 6*b* connected to the heat pump 2 and receiving the air from the hot air delivery fan 5, the canalization 6*b* being arranged alongside at least one wall W of the containment cabin 4.

In this way, the air moved by the hot air delivery fan 5 is conducted towards both the supply nozzle 6*a* and the canalization 6*b* for further hot air supply inside the containment cabin 4.

Accordingly, the drying unit 1 comprises appropriate ducts for hot air supply inside of the containment cabin 4.

As shown in FIG. 1, the canalizations 6*b* comprise at least one opening 6*bh* for supplying hot air inside the containment cabin 4, the opening 6*bh* being made, for example, at a portion of the containment cabin 4 far from the heat pump 2 and the supply nozzle 6*a*, in other words, according to the local reference system of the figures, in a lower portion of the containment cabin 4.

However, it is observed that also other arrangements of the canalizations 6*b* and the openings 6*bh* are possible according to specific needs and/or circumstances, the figures being provided only by way of a non-limiting example.

Still referring to FIG. 1, the drying unit 1 further comprises an aspiration duct 7, which is adapted to retrieve air from the inside of the containment cabin 4, in order to increase the efficiency of the heat pump 2 and therefore of the drying unit 1 itself. In this way, part of the hot air supplied in the containment cabin 4 is retrieved by means of the aspiration duct 7, which, for this purpose, may comprise a suitable fan; the retrieved air is thus reutilized through a forced circulation mechanism of the air, which makes the drying unit 1 much more efficient from an energetic point of view.

Furthermore, the drying unit 1 comprises an ozone generator 8 in order to perform a sanitization of the containment cabin 4 and therefore of the objects to be dried that are disposed therein, such an ozone generator 8 eliminating viruses, bacteria and bad odors. According to an embodiment, the ozone generator 8 is preferably connected to the interfacing means in order to supply ozone inside the containment cabin 4 through those interfacing means. Alternatively, the ozone generator 8 can be provided with its own means for supplying ozone in the containment cabin 4. Through the ozone generator 8, it is therefore possible to supply ozone inside the containment cabin 4 in order to perform a dry sanitization of the objects contained therein.

In addition to the ozone generator 8, the drying unit 1 further comprises a tank 9, which includes volatile substances to be dispensed inside the containment cabin 4. Similarly, to the ozone generator 8, the tank 9, which is rechargeable, is preferably connected to the interfacing means in order to supply the volatile products contained therein through those interfacing means. Alternatively, the tank 9 can be provided with its own means for supplying volatile substances in the containment cabin 4. According to an embodiment, the tank 9 may contain scented volatile substances, so as to not only dry the objects, but also scent them. Furthermore, the tank 9 may also contain anti-wrinkle volatile products, in order to not only dry the objects, but also iron the objects disposed inside the containment cabin 4.

The drying unit 1 further comprises an illumination system 10, preferably a LED light system, which is supplied by a specific power supply 10' and is adapted to illuminate the inside of the containment cabin 4.

In order to guarantee the correct operation of the drying unit 1, it also comprises at least one temperature sensor (not shown in the figures) adapted to measure the temperature inside the containment cabin 4, as well as further sensors that monitor and control all components of the drying unit 1.

In particular, the components of the drying unit 1 are managed and controlled by means of a suitable central unit 11 integrated into the drying unit 1. In other words, the central unit 11 is programmed to control all the components and all the sensors (such as, for example, the temperature sensors) of the drying unit 1.

The central unit 11 is connected to a user interface 12 comprising, for example, a touch-screen, the user interface 12 being disposed on an internal surface of the containment cabin 4, as illustrated in the figures, or outside of the containment cabin 4, such a user interface 12 communicating with the central unit 11 for example through wireless communication. Of course, the user interface 12 may also be disposed on the drying unit 1 itself and in this case it may be connected to the central unit 11 also by means of a cable system.

Through the user interface 12, a user may manage the entire drying unit 1, for example the user may regulate the temperature and intensity of the hot air that is supplied inside the containment cabin 4, or the ozone and/or scent release, as well as other parameters connected to the components and sensors of the drying unit 1. Furthermore, through the interface 12, it is possible to activate and regulate the illumination system 10, as well as it is possible to set up particular drying programs with suitable hot air inlet/outlet cycles of the heat pump 2.

As previously observed, the possibility of manufacturing a drying unit 1 that is able to be associated with a containment cabin 4 and has the characteristics described above, makes this drying unit 1 particularly interesting when the containment cabin 4 is a shower cabin.

Figure 2A:
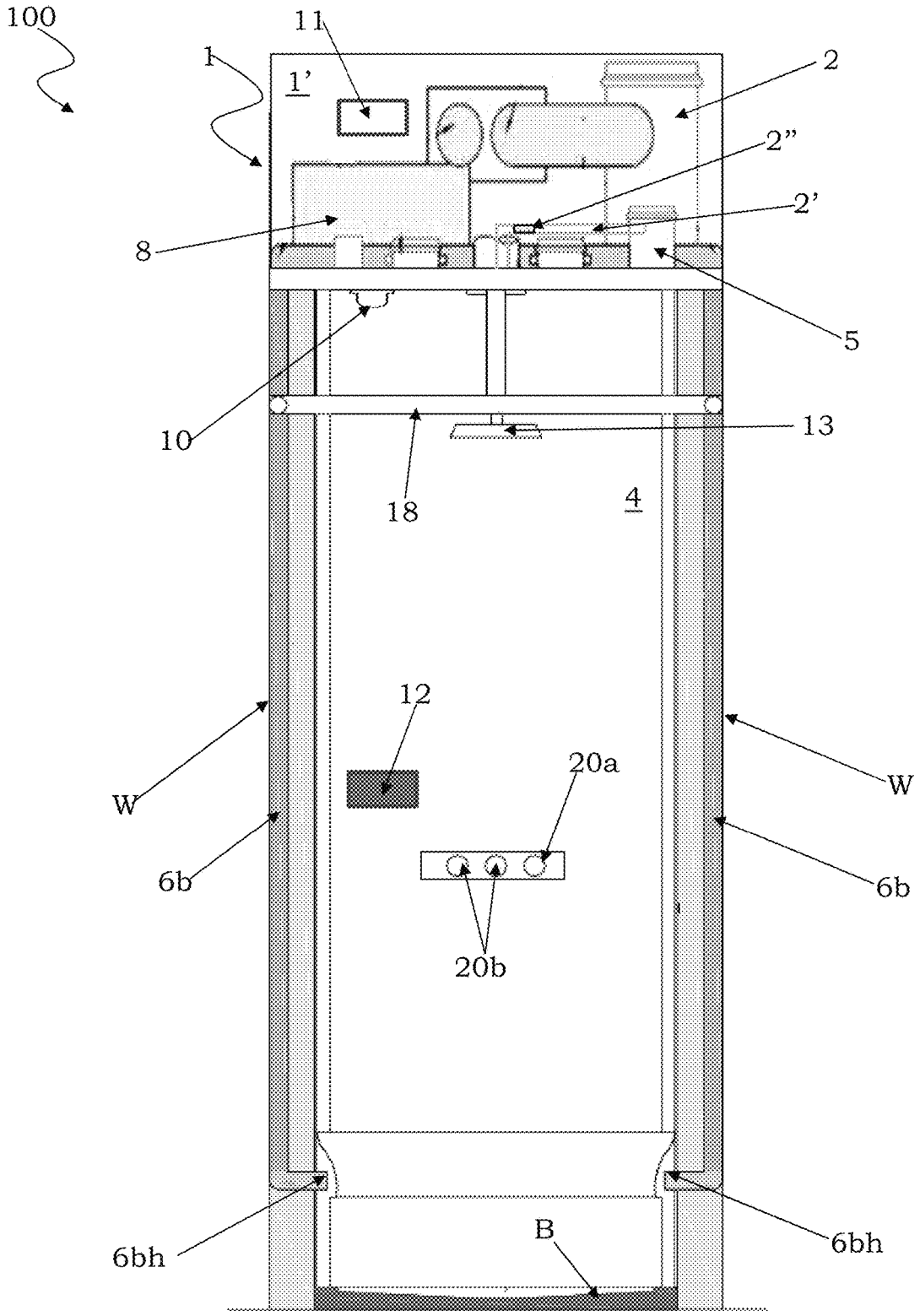
FIGS. 2A and 2B schematically show different sectional views of a drying unit associated with/integrated into a shower cabin.
Figure 2B:
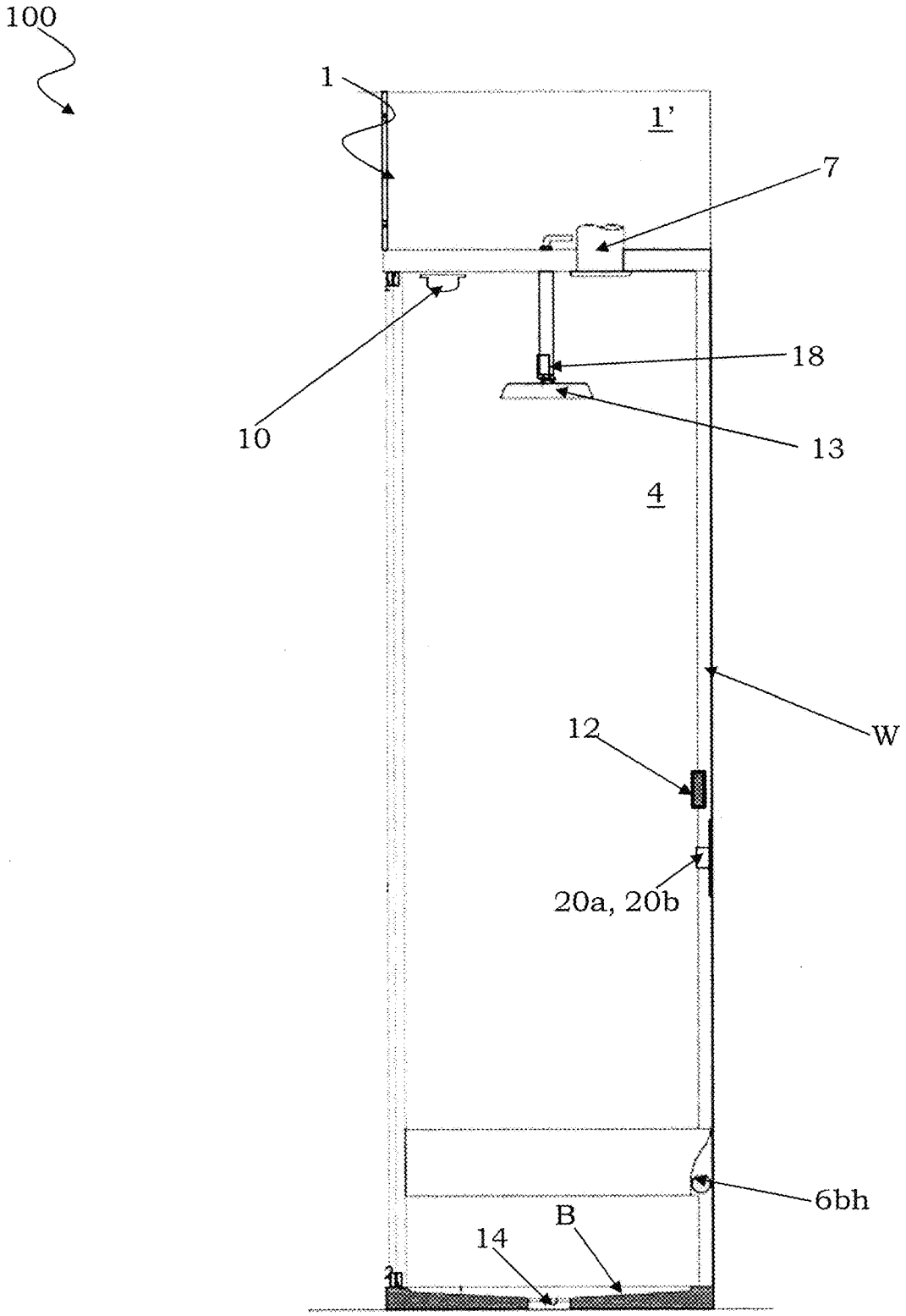

As illustrated in FIGS. 2A and 2B, in a particularly preferred embodiment, the containment cabin 4 is a shower cabin, still indicated with the reference number 4, and the drying unit 1 is apt to be associated with the shower cabin, for example it is apt to be associated to its top in order to close the cabin at the top.

In particular, the shower cabin 4 comprises a shower head 13, which is used to supply the hot air generated by the heat pump 2. Accordingly, in this embodiment, the drying unit 1 comprises connection means to the shower head 13 in the shower cabin 4. Specifically, the delivery fan 5, through the above-mentioned connection means, conducts the hot air generated by the heat pump 2 to the shower head 13, which in turn acts as an interface element between the drying unit 1 and the shower cabin 4, supplying hot air in order to dry the objects contained therein. In other words, in this embodiment, the shower head 13 works as the hot air supply nozzle 6*a* of FIG. 1 and it may therefore be considered as an integrating part of the drying unit 1.

As a consequence, the shower cabin 4 may be in a classic configuration in which the shower head 13 is adapted to supply water, herein referred to as "washing configuration", or in a configuration in which the shower head 13 is adapted to supply hot air, herein referred to as "drying configuration".

In this embodiment, in order to switch between the washing configuration and the drying configuration, the drying unit 1 comprises switching means (not shown), such as, for example, a flow diverter. Through the flow diverter, which can be installed into the connection means to the shower head 13, a user may switch the shower cabin 4 from the washing configuration to the drying configuration, in which the drying unit 1 also uses the preexisting plumbing of the shower cabin 4 in order to conduct hot air inside of it.

The flow diverter may be driven manually by means of a handle, or it may be electric and provided with motorized means that can be driven for example by means of an input from the user interface 12. In the case of a manually activated diverter, it may be activated by means of a handle 20*a* arranged near the taps and fittings 20*b* of the shower cabin 4. In any case, by means of the handle or the input from the user interface, the switching means are activated at the interfacing means.

The embodiment in which the containment cabin 4 is a shower cabin is particularly preferred, since a shower cabin, in particular of the kind that is closed on all sides, is already naturally predisposed to house objects to be dried inside of it and to receive the drying unit 1. In fact, the shower cabin 4 is provided with a preexisting plumbing that the drying unit 1 can interface with and is made of materials adapted to be used in a humid environment.

As shown in FIG. 2B, the shower cabin 4 comprises a drain 14 at its base portion B, the drain 14 comprising a draining plug, through which it is possible to discharge part of the hot air, as well as to drain the water and the condensation produced by the drying process.

Figure 3:
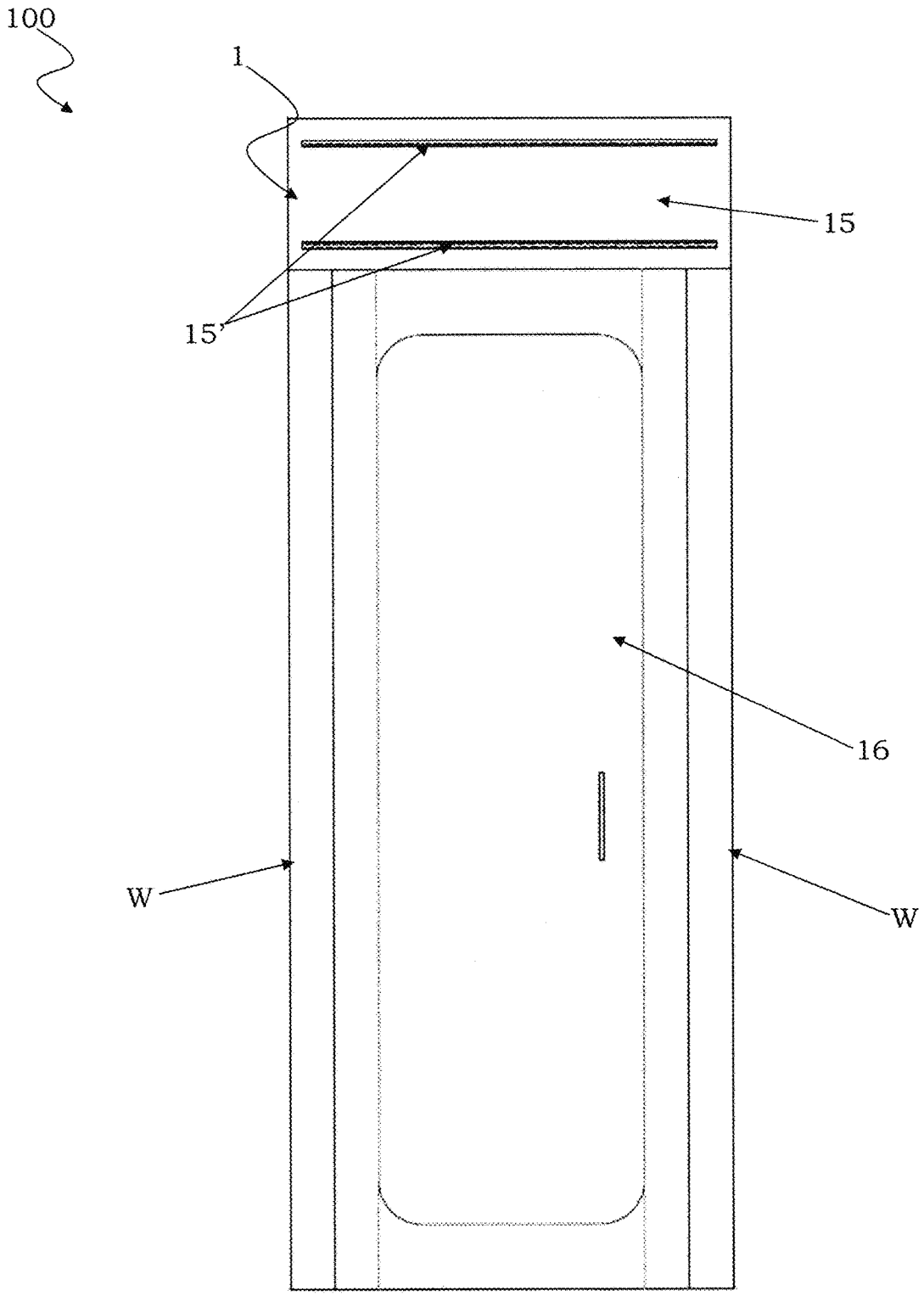
FIG. 3 schematically shows a front view of the drying unit according to the present disclosure and of the shower cabin with/into which it is associated/integrated.

As shown in FIG. 3, the drying unit 1 comprises an openable panel 15 in order to allow the access to the components housed therein, the openable panel 15 being provided with suitable slots 15' that allow the ventilation of the drying unit 1 itself.

Figure 4:
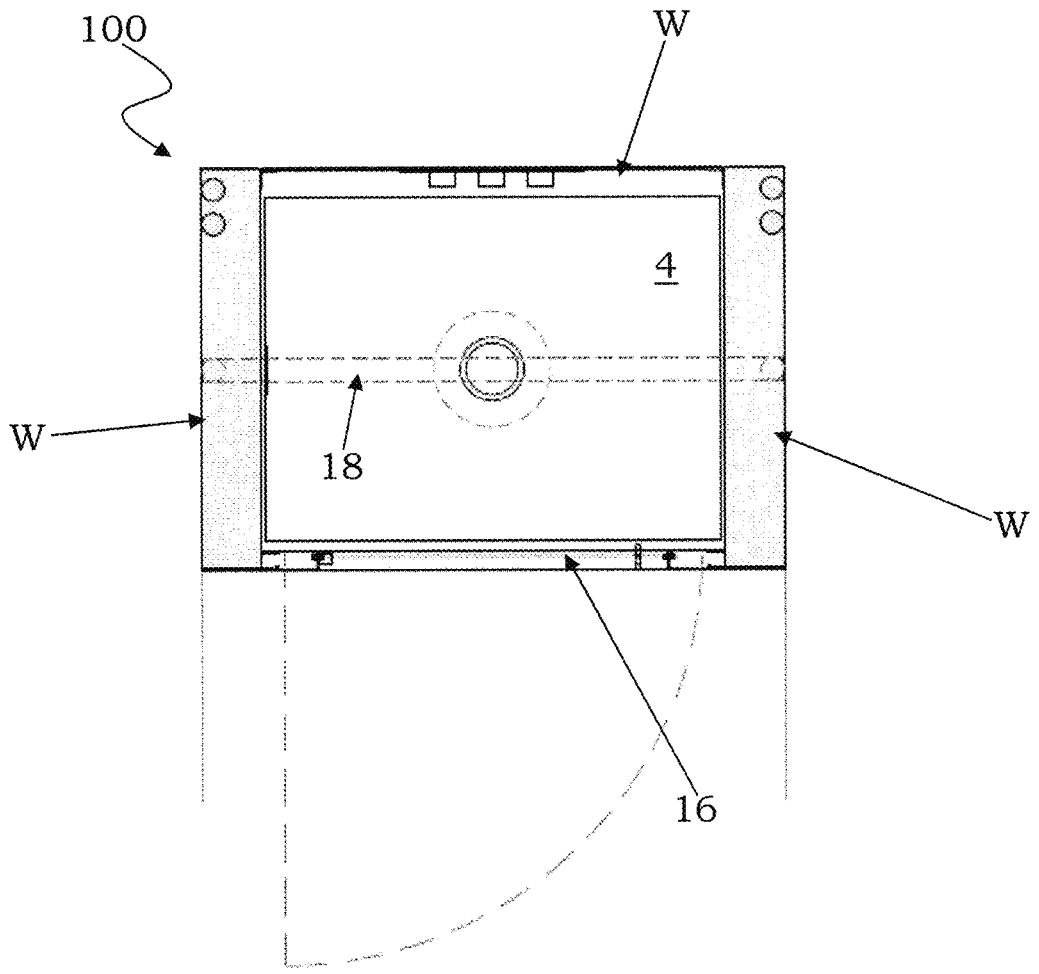
FIG. 4 schematically shows a plant view of a containment cabin with/into which the drying unit according to the present disclosure is associated/integrated.

Furthermore, referring to FIGS. 3 and 4, the containment cabin 4 comprises a door 16 provided with seals adapted to achieve a tight closure.

Figure 5:
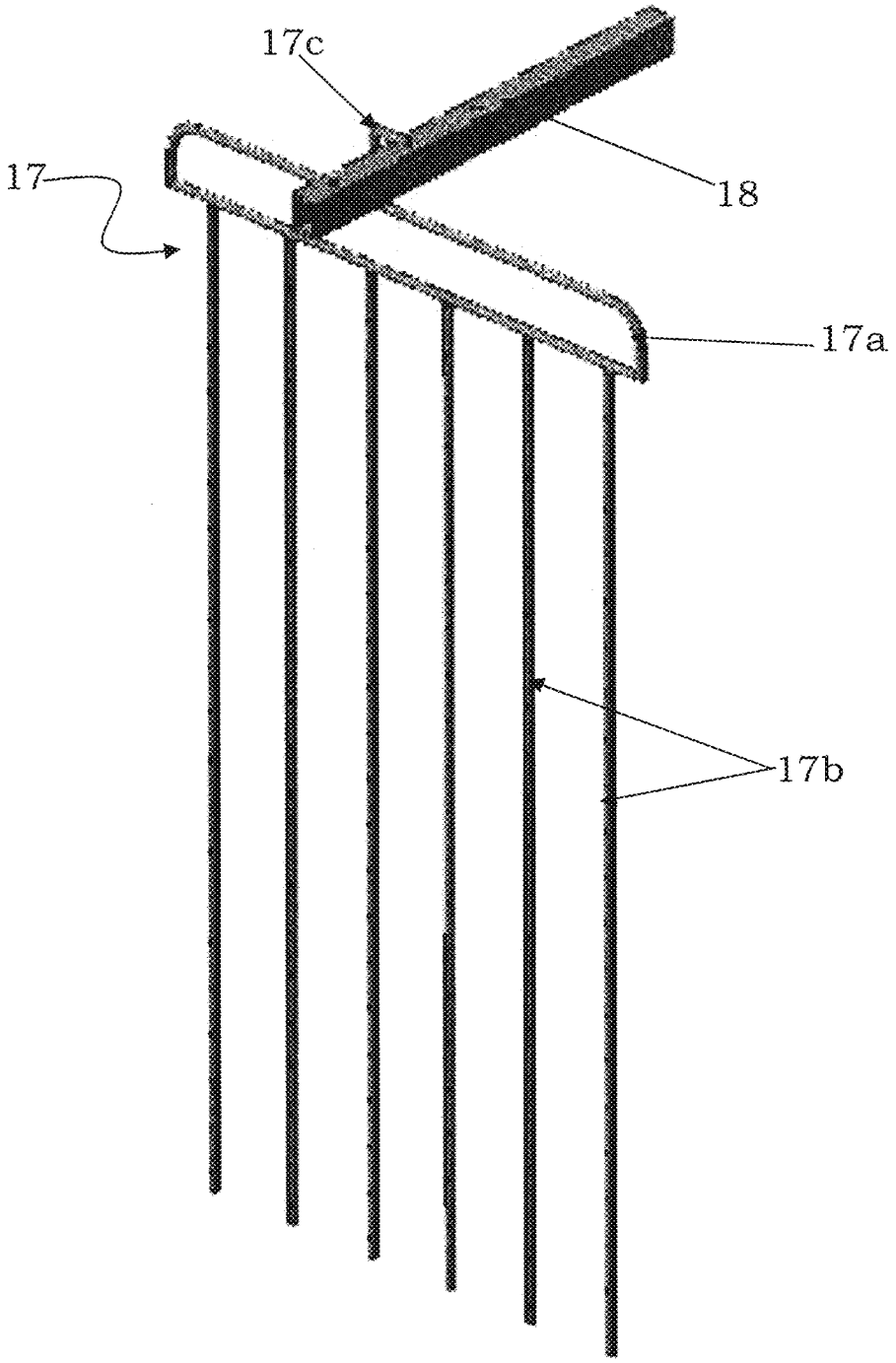
FIG. 5 schematically shows a perspective view of a hanger associated with the drying unit of the present disclosure.

In order to guarantee an orderly arrangement of the objects that are to be dried inside the containment cabin 4, as well as to guarantee a correct drying and/or ironing thereof, the drying unit 1 comprises at least one hanger 17 on which the objects are be disposed, the hanger 17 being illustrated in detail in FIG. 5.

Figure 6A:
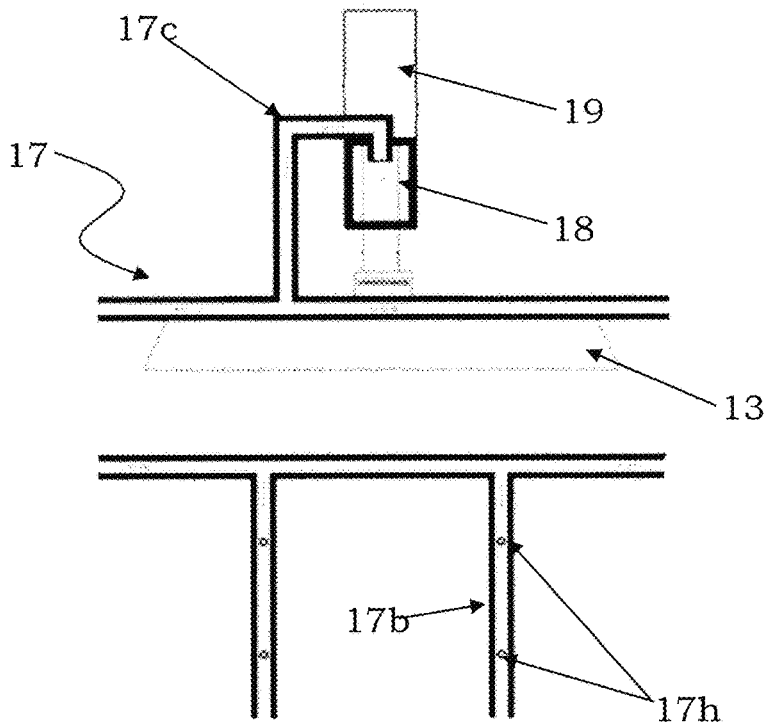
FIG. 6A shows a detail of the hanger of FIG. 5, while FIG. 6B schematically shows a plurality of hangers sustained by a support element.

In particular, the hanger 17 comprises a hollow hanger body 17*a* and a plurality of protruding portions 17*b* from the hanger body 17*a*, those protruding portions 17*b* being hollow and being provided with a plurality of openings 17*h*, which are illustrated in greater detail in FIG. 6A.

In the embodiment shown in the figures, the hanger 17 is sustained by a rod-shaped supporting element 18, which is preferably removably associated with containment cabin 4. The hanger 17 is therefore associated with the containment cabin 4 by means of the supporting element 18.

The supporting element 18, which is preferably hollow, is in turn sustained by a specific support 19, for example a ceiling support, which is able to conduct the hot air generated by the hot air generation means 2 inside of the supporting element 18. For example, as illustrated in FIG. 6A, the support 19 may be manufactured at the shower head 13, in particular at the connection means to the shower head 13, in order to utilize said means to conduct the hot air into the supporting element 18.

Furthermore, referring again to FIG. 1 or FIG. 2A, according to an embodiment, the supporting element 18 comprises suitable connection means to the canalizations 6*b*, in order to let the hot air generated by the heat pump 2 circulate inside of it, so as to improve and quicken the drying process of the objects contained in the containment cabin 4.

Returning now to FIG. 6A, the hanger 17 is in turn associated with the supporting element 18 by means of a hooking portion 17*c* extending from the hanger body 17*a*. Specifically, the hooking portion 17*c* is substantially C-shaped and is adapted to engage with holes made into the supporting element 18, the end portion of the hooking portion 17*c* (in particular the portion not connected to the hanger body 17*a*) comprising an opening that allows, when it is engaged with the holes of the supporting element 18, the passage of air from the supporting element 18 to the hanger 17.

Of course, the shape of the hanger and of the hooking portion may vary according to the needs and/or circumstances, the figures being provided only by way of a non-limiting example.

As mentioned before, the hanger 17 is hollow in order to allow the air from the supporting element 18 to circulate inside of it, the air being supplied in the containment cabin 4 by means of the openings 17*h* of the protruding portions 17*b*.

Figure 6B:
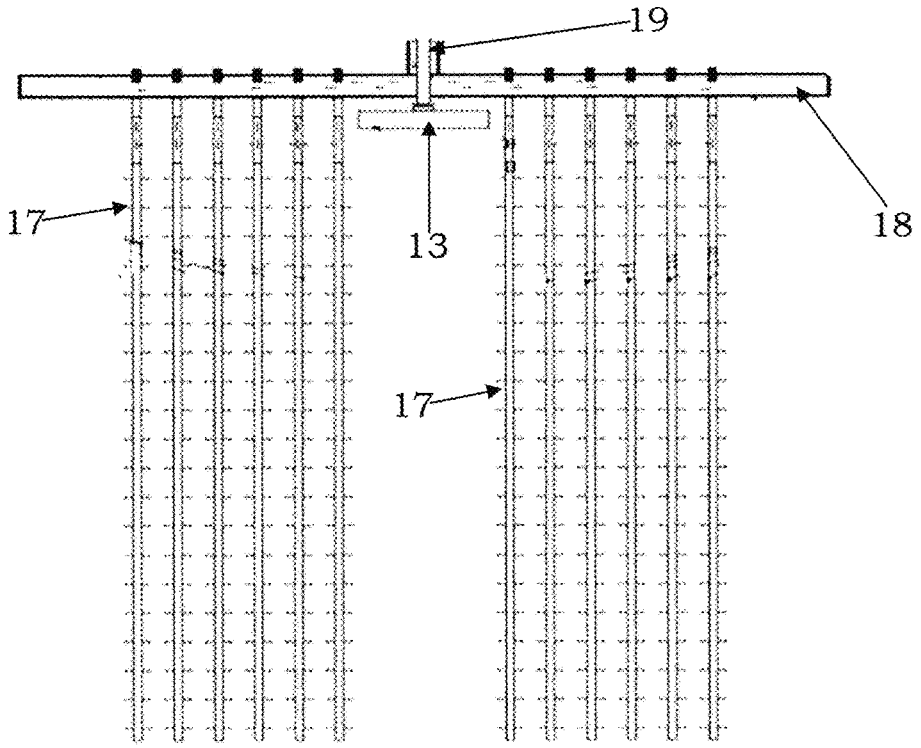

As shown in FIG. 6B, the supporting element 18 comprises a plurality of holes, which the hooking portion 17*c* of the hanger 17 can engage with, and therefore several hangers 17 may be disposed, one parallel to the other, on the supporting element 18.

Of course, the embodiment shown in FIGS. 5 and 6A-6B is provided only by way of a non-limiting example, and also other ways of associating the hanger 17 to the drying unit 1 are possible. For example, the hanger 17 may be associated directly to the body 1' of the drying unit 1, without the supporting element 18.

In an embodiment, the hanger 17 further comprises a plurality of nozzles, made at the openings 17*h*, in order to make the hot air supply and therefore the drying process of the objects disposed on the hanger 17 more efficient.

The present disclosure also refers to an apparatus, indicated by the reference number 100, for drying objects contained therein.

In particular, the apparatus 100 comprises a containment cabin 4 adapted to house objects that are to be dried inside it, those objects being dried by means of a drying unit 1, comprised in the apparatus 100, the drying unit 1 being adapted to conduct hot air into the containment cabin 4.

Advantageously, the drying unit 1 is of the type described above, allowing the manufacturing of the drying apparatus 100 which is versatile and provided with a plurality of functions.

In a particularly preferred embodiment, the containment cabin 4 is a shower cabin into which the drying unit 1 is integrated. Conveniently, the shower cabin 4 comprises means for switching from a configuration in which the shower cabin 4, in particular a supply nozzle 6*a* (such as for example a shower head 13), emits water, and a configuration in which it emits hot air. In this way, it is possible to manufacture a multifunctional apparatus, which is able to be both a shower cabin and a dryer, depending on the needs, such an apparatus comprising all the means for easily switching between the two configurations, as described above.

As observed, the drying unit 1 is preferably integrated in the shower cabin and the apparatus 100 is therefore monobloc, wherein the drying 1 and the containment cabin 4 are provided together in such a monobloc.

The apparatus 100 can be in the shape of a prefabricate, including the drying unit 1 and the containment cabin 4, such a prefabricate being apt to be arranged in a domestic or hospitality environment.

The apparatus can also be modular depending on different needs and/or requirements.

In conclusion, the present disclosure provides a drying unit which is structured so as to be easily associated with a domestic and/or hospitality containment cabin, such as a shower cabin or any other suitable domestic space, the drying unit generating and conducting hot air into the containment cabin by means of appropriate means interfacing therewith.

Advantageously, the drying unit is structurally independent from the containment cabin it interfaces with, such a unit being structured and sized in order to be associated with a wide range of containment cabins in domestic and/or hospitality environments. The drying unit thus comprises means that make it very versatile and adaptable to different needs.

The possibility of easily associating the drying unit to a domestic or hospitality containment cabin is therefore a distinctive aspect of the present disclosure. In this way, by associating such an independent unit to an appropriate cabin (even preexisting), it is possible to efficiently dry objects disposed therein without space obstruction.

The drying unit of the present disclosure may also be a thermo-hydraulic unit, which can be integrated (for example in the manufacturing step) into a specific cabin of suitably selected size and shape, the cabin being organized for this purpose.

The solution in which the containment cabin is a shower cabin is particularly advantageous, as a shower cabin is naturally predisposed to house the drying unit, as is illustrated above. In this case, it is therefore possible to manufacture an efficient, multifunctional drying apparatus, with both a shower cabin function and a dryer function.

In any case, it is pointed out that it is not difficult to convert any kind of domestic cabin in order to house the unit therein, since such a unit is naturally predisposed to be associated to the cabin in a simple way, with few modifications. For example, in case the cabin is not a shower cabin, it is only preferable, even if it is not necessary, that the cabin is provided with a draining plug, and possibly to cover the internal walls thereof with an appropriate coating, so as to predispose it to the drying process. Accordingly, it is sufficient to suitably size the drying unit, as well as the heat pump comprised therein, in relation to the cabin the drying unit is associated with.

Conveniently, the drying unit guarantees the rapid drying of fabric sheets, garments and similar objects with hot, filtered and purified air. The forced ventilation of the relative containment cabin allows drying the objects without creasing and in short time. By means of a specific user interface, it is also possible to monitor the entire drying unit and to select the drying program that is most suitable to specific needs, the user interface being connected to a central unit that controls and monitors all the components and the possible sensors of the drying unit.

Furthermore, a tank containing aromas and specific, selectable scents is provided, in order to obtain delicately scented garments, as well as containing anti-wrinkle volatile products, in order to obtain also an ironing-effect on those garments.

Moreover, the ozone treatment allows a dry sanitization of the objects to be dried, eliminating bad odors, viruses and bacteria. Accordingly, the presence of the ozone generator allows not only drying, but also sanitizing/dry-cleaning the objects without using toxic products, such an ozone generator being inserted very easily into the drying unit.

Finally, the possibility of associating hollow and internally ventilated hangers to the drying unit allows organizing the space inside the containment cabin in an efficient way, and therefore allows increasing the drying efficiency and the possible ironing efficiency. It is in fact observed that the drying unit is naturally predisposed to be connected with such a hanger.

From the foregoing, it will be appreciated that, although specific embodiments of the disclosure have been described herein for purposes of illustration, various modifications may be made without deviating from the spirit and scope of the disclosure. Accordingly, the disclosure is not limited except as by the appended claims.

The invention claimed is:

1. A drying unit for at least one of domestic and hospitality use, comprising hot air generation means, and interfacing means adapted to interface the hot air generation means with a containment cabin and to conduct hot air generated by the hot air generation means into the containment cabin, wherein the drying unit is adapted to be associated with the containment cabin in order to dry objects contained therein, wherein the containment cabin is a shower cabin and the interfacing means of the drying unit with the shower cabin is a shower head, and wherein the drying unit includes switching means for switching from a drying configuration, in which the shower head is apt to emit the hot air, to a washing configuration, in which said shower head is apt to emit water, and vice versa.

2. The drying unit according to claim 1, wherein the drying unit is integrated into the shower cabin.

3. The drying unit according to claim 1, wherein the drying unit is associated with the top of the shower cabin.

4. The drying unit according to claim 1, wherein the shower head receives hot air by means of a hot air delivery fan connected to the hot air generation means.

5. The drying unit according to claim 4, further comprising at least one canalization, which is arranged alongside at least one wall of the shower cabin and is provided with at least one opening for a further supply of hot air into the shower cabin, the at least one canalization receiving hot air by means of the hot air delivery fan.

6. The drying unit according to claim 1, further comprising an aspiration duct adapted to retrieve at least part of the hot air from the inside of the shower cabin.

7. The drying unit according to claim 1, further comprising a central unit adapted to the management and control thereof, the central unit being connected to a user interface through which a user manages the drying process.

8. The drying unit according to claim 1, wherein the hot air generation means comprise a heat pump connected to air inlet and outlet ducts.

9. The drying unit according to claim 1, further comprising at least one of:

(1) an ozone generator adapted to supply ozone in the containment cabin in order to perform a dry sanitization of the objects in the containment cabin; and (2) a tank including further volatile substances to be supplied in the containment cabin, the volatile substances being selected from perfumed or anti-wrinkle substances, or from a combination thereof.

10. The drying unit according to claim 1, further comprising an illumination system adapted to illuminate the containment cabin.

11. The drying unit according to claim 1, further comprising at least one hanger, which is housed in the containment cabin and is adapted to sustain objects to be dried, the at least one hanger being able to let the hot air produced by the hot air generation means circulate therein and comprising a plurality of openings for supplying hot air in the containment cabin.

12. A drying apparatus comprising a containment cabin adapted to house objects to dry therein, as well as a drying unit adapted to conduct hot air into the containment cabin and to be associated with the containment cabin in order to dry objects contained therein, wherein the drying unit comprises hot air generation means, and interfacing means with a containment cabin, wherein the interfacing means is a shower head adapted to conduct hot air generated by the hot air generation means into the containment cabin, and wherein the containment cabin is a shower cabin, the apparatus comprising means for switching from a configuration in which water is supplied therein to a configuration in which the hot air is supplied therein.

13. The apparatus according to claim 12, wherein the containment cabin houses at least one hanger which is adapted to sustain objects to be dried, the at least one hanger being able to let the hot air produced by the hot air generation means circulate therein and comprising a plurality of openings for supplying the hot air in the shower cabin.

14. The apparatus according to claim 12, wherein the drying unit is integrated in the shower cabin.

15. The apparatus according to claim 12, further comprising:

an ozone generator adapted to supply ozone in the shower cabin in order to perform a dry sanitization of the objects in the containment cabin; and/or a tank including further volatile substances to be supplied in the shower cabin, the volatile substances being selected from perfumed or anti-wrinkle substances, or from a combination thereof.

* * * * *